United States Patent [19]

Morax

[11] Patent Number: 4,527,455

[45] Date of Patent: Jul. 9, 1985

[54] DEVICE FOR OPENING ENVELOPES OR THE LIKE

[75] Inventor: François Morax, Rüschlikon, Switzerland

[73] Assignee: DELTA-REAL Establishment, Fürstentum, Liechtenstein

[21] Appl. No.: 433,118

[22] PCT Filed: Mar. 12, 1982

[86] PCT No.: PCT/EP82/00086

§ 371 Date: Sep. 30, 1982

§ 102(e) Date: Sep. 30, 1982

[87] PCT Pub. No.: WO82/03206

PCT Pub. Date: Sep. 30, 1982

[30] Foreign Application Priority Data

Mar. 12, 1981 [DE] Fed. Rep. of Germany ..... 3109501

[51] Int. Cl.[3] ..... B43M 7/00

[52] U.S. Cl. ..... 83/588; 83/582; 83/611; 83/912

[58] Field of Search ..... 83/524, 563, 583, 588, 83/590, 912, 582, 610–612, 605, 606, 589

[56] References Cited

U.S. PATENT DOCUMENTS

| | | | |
|---|---|---|---|
| 605,093 | 6/1898 | Fox | 83/912 |
| 628,908 | 6/1899 | Lewis | 83/611 |
| 1,098,510 | 6/1914 | Krauth | 83/611 |
| 1,302,398 | 6/1919 | Mangini | 83/603 |
| 1,666,533 | 4/1928 | Heck et al. | 83/583 |
| 1,833,549 | 9/1931 | Anderson | 83/395 |
| 1,963,873 | 6/1934 | Smith | 164/41 |
| 3,522,752 | 8/1970 | Ford | 83/611 |
| 3,855,891 | 12/1974 | Young | 83/582 |

FOREIGN PATENT DOCUMENTS

| | | | |
|---|---|---|---|
| 248866 | 7/1912 | Fed. Rep. of Germany . | |
| 305445 | 5/1917 | Fed. Rep. of Germany . | |
| 504710 | 8/1930 | Fed. Rep. of Germany . | |
| 515433 | 12/1930 | Fed. Rep. of Germany . | |
| 852822 | 10/1952 | Fed. Rep. of Germany . | |
| 863768 | 1/1953 | Fed. Rep. of Germany . | |
| 958364 | 2/1957 | Fed. Rep. of Germany . | |
| 1889742 | 2/1964 | Fed. Rep. of Germany . | |
| 242181 | 10/1946 | Switzerland . | |
| 285809 | 1/1953 | Switzerland | 30/DIG. 3 |
| 621186 | 4/1949 | United Kingdom . | |
| 733080 | 7/1955 | United Kingdom . | |

*Primary Examiner*—James M. Meister
*Assistant Examiner*—John L. Knoble
*Attorney, Agent, or Firm*—Flynn, Thiel, Boutell & Tanis

[57] ABSTRACT

A device for opening envelopes includes a movable knife blade which is mounted on a swingable knife holder and is urged towards a complementary edge which is preferably formed by a further knife blade. The movable knife blade is inclined in its longitudinal direction. A cutting operation is effected at the point of engagement of the movable knife blade with the stationary one. Movement of the movable knife blade causes the edge of an envelope be gradually severed. The knife blades are supported on a base part which preferably has, underneath the cutting parts, a removable waste drawer.

10 Claims, 7 Drawing Figures

DEVICE FOR OPENING ENVELOPES OR THE LIKE

FIELD OF THE INVENTION

The invention relates to a device for opening envelopes or the like having a base part, a movable knife blade, the cutting edge of which co-operates with a complementary member, and an actuating device.

BACKGROUND OF THE INVENTION

The most varied devices for opening envelopes or the like are already known. In the case of one such known device, a razor can be used to sever the edge of the envelope. It is guided exchangeably on a carriage which is displaceable along the letter and which is displaced by hand to open the envelope. To open the envelope, a board-like complementary member co-operates with the razor. This known device does not fulfill all the requirements posed. The opening of the envelope, particularly fairly long envelopes, is time-consuming and the cutting edge of the blade does not hold out for a long time.

The problem underlying the invention is to provide a device for opening envelopes or the like which is simple in construction, is simple to operate, extends the lives of the knives and cuts off the edge of the envelope that is to be severed without great expenditure of energy.

SUMMARY OF THE INVENTION

The invention solves this problem by providing the movable knife blade on a swingable knife holder.

BRIEF DESCRIPTION OF THE DRAWINGS

The invention will be explained in more detail hereinunder with reference to several exemplary embodiments which are shown in the drawings. In the drawings.

DETAILED DESCRIPTION

Figure 1:
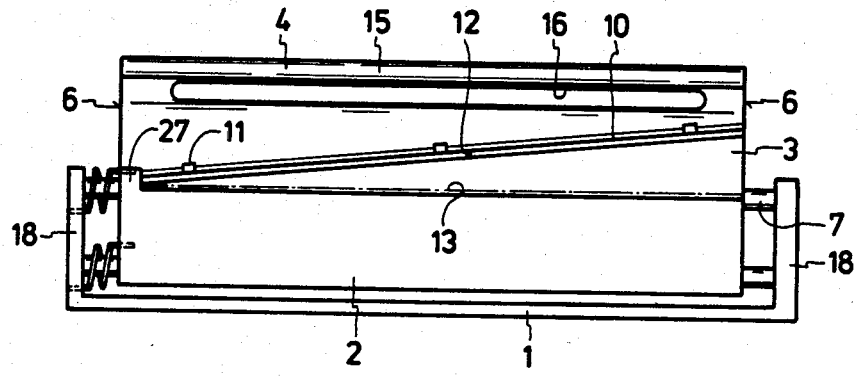
FIG. 1 shows a front view of a device embodying the invention.

The device for opening letters or the like has a base part 1, a stationary knife holder 2, a movable knife holder 3 and a handle 4 which is formed on this.

The movable knife holder 3 is a substantially rectangular block 5 extending over the entire length of the knife and having flat side surfaces 6.

Formed on the side surfaces 6 are eccentrically-arranged pivots 7, which are mounted for rotation in bearings (not shown in more detail) of the base part 1.

On the front end face the block 5 has a circular segment or stop surface 48, the central point of which forms the centre axis of the pivots 7.

Linking to the circular segment surface 8 on the upper side and rising slightly inwardly is a flat bearing surface 9 for the movable knife blade 10. The movable knife blade 10 is fastened by means of screws 11 to the block 5. The bearing surface 9 is inclined in the longitudinal direction of the block 5, namely, as is evident from FIG. 1, rising in the drawing from left to right.

The movable knife blade 10 projects with its cutting edge 12 beyond the circular segment surface 8, namely past the edge that is to be cut off from the envelope 13 that is to be opened; preferably the cutting edge 12 projects by 0.6 mm over the circular segment surface 8, so that 0.6 mm of the envelope 13 is cut off.

The block 5 continues in the rearward region into an upwardly-extending part 14, which extends the entire length of the block, in order then to change into a part 15 which, bent towards the front side, extends forwardly while tapering in its cross-section. By the parts 14 and 15 there is formed the handle 4 which for the actuation of the device is moved by hand in the direction of the arrow I.

So that the application of the envelope 13 can be observed from above and in order to be able to release the screws 11 for exchanging the knife blade 10, an aperture 16 is formed, as indicated in broken lines, in the handle part 15.

Figure 2:
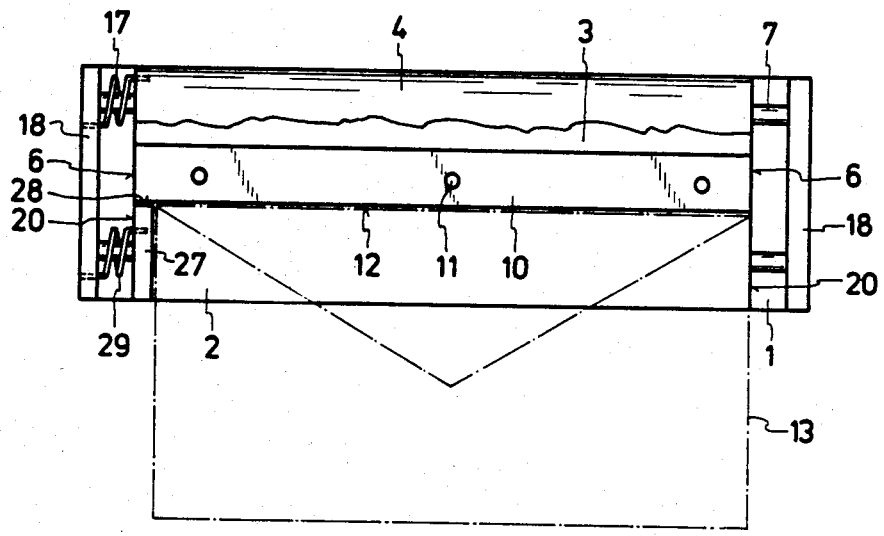
FIG. 2 shows a top view of the device of FIG. 1.

For the automatic return of the knife block 5 into the initial position, limited by a stop (not shown), after actuation of the device the block 5 is spring-loaded, whereby it is returned in the direction of the arrow II. As is evident from FIG. 2, for this a spiral spring 17 is wound about the pivot 7 there, one end of which is connected to one side cheek 18 of the base part 1 and the other end of which is connected to the block 5.

Mounted in front of the knife block 5, the stationary knife holder 2 is also arranged as a longitudinally-extending block 19. It is mounted so as to be limitedly swingable in the side cheeks 18 of the base part 1. For this, the parallel side surfaces 20 of the block have pivots 21, which are mounted for rotation in bearings (not shown) of the side cheeks 18. A further knife blade 23 is fastened by means of screws 24 to the flat surface 22 facing the block 5 and extends from the pivot 21 obliquely upwards and towards the block 5. The cutting edge 25 of the knife blade 23 extends flush with the flat upper side 26, which serves as a bearing or support for the envelope 13. Formed on one side is a side stop 27, towering above this upper side 26, for the envelope 13. This side stop 27 is, in this respect, so arranged that the envelope 13 is insertable just as far as the circular segment surface 8 up to a vertex between the cutting edges 12 and 25.

The knife edges 12 and 25 come into contact in the region of the end faces 28, facing the knife edges 12 and 25, of the side stop 27. This contact is constantly maintained in that the knife block 19 is spring-loaded in the direction of the arrow III towards the block 5. For this, arranged in turn about at least one of the pivots 21, is a spiral spring 29, one end of which is connected to the side cheek 18 and the other end of which is connected to the block 19.

The base part 1 is U-shaped in design and has two lateral cheeks 18 and a base 30. In the base 30 there is a recess 31, which is covered by a rearwardly-extractable waste drawer 32 for the reception of the cut-off envelope edges.

Figure 4:
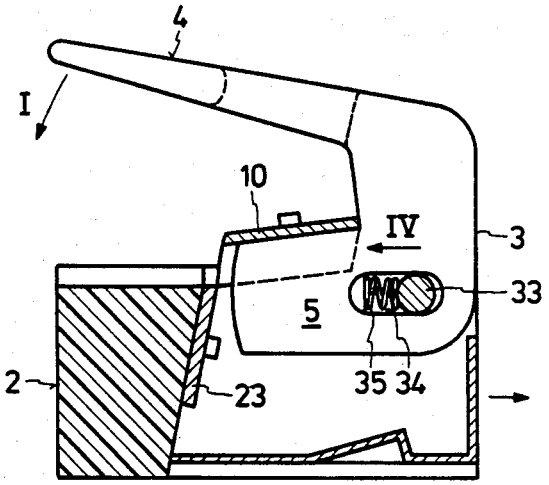
FIG. 4 shows a view, similar to FIG. 3, of a modified embodiment.

In the case of the modified embodiment shown in FIG. 4, the block 19 is functionally replaced by a rigid component part of the base part 1. The knife holder block 5 is not only swingably mounted, but it is also movable in the direction IV towards the stationary knife blade 23. For this, a space-bound shaft 33 for the knife block 5 is provided, which is mounted rigidly in the side cheeks 18 of the base part 1. The block 5 has a slot-like recess 34, through which the shaft 33 extends. Springs 35 are supported on the one hand against the wall of this recess and on the other hand against the rigid shaft 33, whereby the knife block 5 is held constantly with its knife edge 12 forced against the knife edge 25 in the region of contact.

Figure 5:
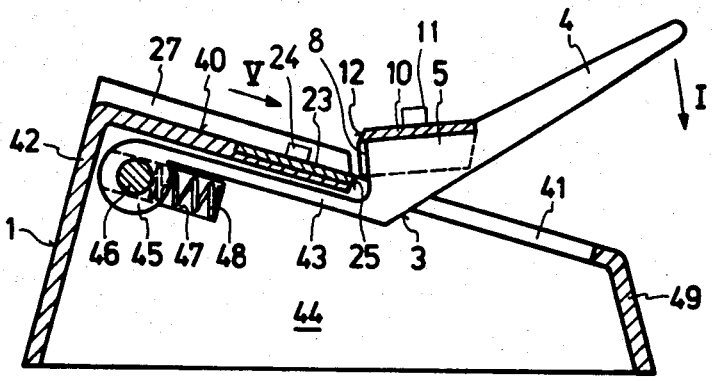
FIG. 5 shows a view, similar to FIG. 3, of another embodiment.

In the case of the modified embodiment which is shown in section in FIG. 5, the base part 1 is designed open towards the bottom. The flat knife blade 23 is fastened rigidly by means of screws (not shown) in a countersunk position on the flat upper side 40 and drops away slightly in the abutment direction V for the envelope or the like that is to be opened. The undercut cutting edge 25 of this knife 23 projects somewhat beyond the wall of the upper side 40 into the free space of an opening 41 on the upper side 40.

The block 5 which carries the movable knife blade 10 has, in the appropriate circumstances, only lateral arms 43 which extend from the block 5 towards the front side 42 and which are mounted swingably in the side walls 4. The hubs 45 engage for this purpose by means of pivots 46 into slotted holes 47 in the side walls 44 and are acted upon thereby means of compression springs 48 in a direction towards the front side 42. The cutting edge 12 of the knife blade 10, which projects by the amount to be cut off of the envelope or the like beyond the block 5 is thus held constantly in abutment with the edge 25 of the knife blade 23. The knife blade 10 extends again, as in the case of the embodiment in accordance with FIG. 3, inclined in the longitudinal direction of the block 5 and remains even in the initial position in abutment with the knife blade 23.

On the block 5 the handle 4 continues, directed contrary to the swivel arms 43, in the direction of the rear side 49. The cut is effected by actuating the handle 4 in the direction of the arrow I. In the case of this embodiment, thus, the cut can be effected by actuating the handle on the side remote from the abutment.

Figure 3:
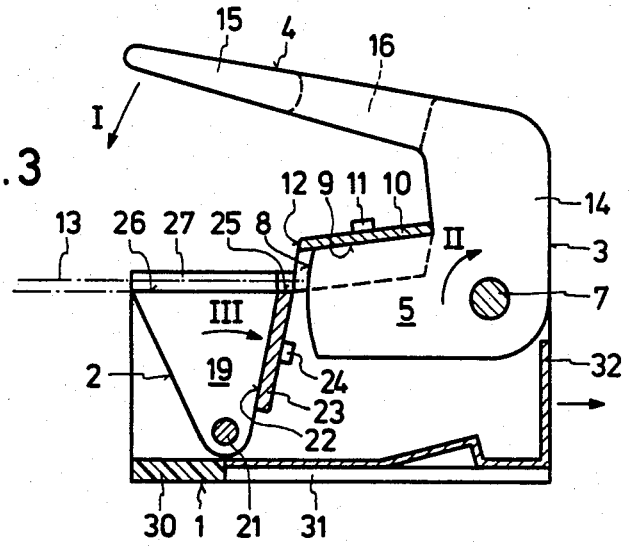
FIG. 3 shows a side view, partially in section, of the device of FIG. 1.
Figure 6:
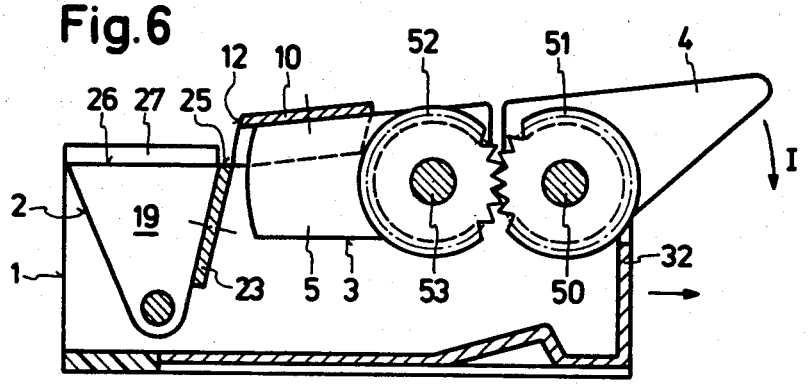
FIG. 6 shows a view, similar to FIG. 3, of a further embodiment.

The embodiment in accordance with FIG. 6 corresponds substantially to the embodiment in accordance with FIG. 3. Instead of actuating the knife block 5 directly by a handle 4 on the abutment side, here a movement of the knife block 5 by way of a gear arrangement is provided for. The handle 4 is provided in the region of the waste drawer 32. It is provided swingably on the shaft 50, which is mounted for rotation in the two side cheeks. Seated on this shaft at least on one side is a toothed wheel 51. This meshes with a complementary toothed wheel 42, which is seated securely on the swivel shaft 53, which is mounted for rotation in the side walls and to which the block 5 is connected in a torsionally-fast manner. Here, too, the handle 4 for actuating the cutting operation is disposed on the side remote from the abutment of the envelope or the like.

The cut can be accomplished more easily by proper selection of the transmission ratio for the toothed wheels 51, 52.

Figure 7:
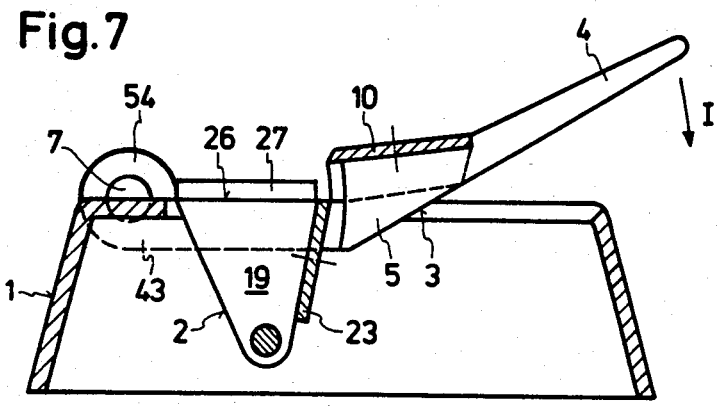
FIG. 7 shows a view, similar to FIG. 3, of still a further embodiment.

The embodiment in accordance with FIG. 7 is largely similar to that in accordance with FIG. 5. What is different is merely the fact that the swivel arms 43 for the knife block 5 extend laterally of the knife blade 22 and not underneath the same. The knife block 10 is in turn designed as in the case of the embodiment in accordance with FIG. 3. For mounting the lateral arms 43, the housing 1 can have lateral hubs 54.

The embodiments of the invention in which an exclusive property or privilege is claimed are defined as follows:

1. An apparatus for opening envelopes, comprising: base means; an elongate arm supported at a first end thereof on said base means for pivotal movement about a pivot axis and having at a second end thereof remote from said first end means defining a stop surface which faces toward said pivot axis; means defining an upwardly facing support surface on said base means which is located between said pivot axis and said stop surface, which terminates in an elongate first cutting edge spaced a small distance from said stop surface, and which extends from said first cutting edge in a direction away from said stop surface; means defining a first knife blade which projects outwardly from said stop surface and has an elongate second cutting edge thereon which extends at a small angle to and slidably engages said first cutting edge; and a handle fixedly supported on said arm at said second end thereof and projecting outwardly in a direction away from said pivot axis.

2. The apparatus according to claim 1, including means supporting said arm for lengthwise movement relative to said base means, so that said stop surface can move toward and away from said first cutting edge; and including resilient means yieldably urging lengthwise movement of said arm relative to said base means in a direction corresponding to movement of said stop surface toward said first cutting edge, whereby said second cutting edge is maintained in said sliding engagement with said first cutting edge.

3. The apparatus according to claim 2, wherein said means supporting said arm for lengthwise movement includes a slot provided in said base means and extending approximately parallel to said support surface, and an axle slidably supported in said slot and having said arm supported thereon, said pivot axis being coincident with said axle; and wherein said resilient means includes a helical compression spring disposed in said axle and one end of said slot.

4. The apparatus according to claim 3, wherein said base means has two spaced side walls, wherein a said slot is provided in each of said side walls, wherein a respective end of said axle is slidably supported in each said slot, and wherein a respective said helical compression spring is provided in each said slot.

5. The apparatus according to claim 1, wherein said support surface is inclined downwardly in a direction toward said stop surface.

6. The apparatus according to claim 1, wherein said first cutting edge and said pivot axis extend substantially horizontally and are approximately parallel.

7. The apparatus according to claim 1, wherein said first knife blade is releasably secured on said arm; wherein said base means includes a base and a second knife blade releasably secured on said base, said second knife blade having said first cutting edge and a portion of said support surface thereon; and wherein said base has a surface thereon which is flush with said portion of said support surface of said second knife blade and is provided on a side of said second knife blade remote from said first cutting edge, said surface on said base being a further portion of said support surface.

8. The apparatus according to claim 1, wherein said base means includes a base and a block supported on said base for pivotal movement about a further axis which is parallel to said pivot axis and is spaced from said support surface, said support surface and said first cutting edge being provided on said block.

9. The apparatus according to claim 8, wherein said first knife blade is removably secured to said arm; and including a second knife blade which is removably secured to a side surface of said block and extends approximately normal to said support surface thereon, said first cutting edge being provided on said second knife blade.

10. The apparatus according to claim 9, wherein said base has an axle supported thereon coincident with said pivot axis of said arm, said arm being supported on said axle for pivotal movement about said pivot axis.

* * * * *

UNITED STATES PATENT AND TRADEMARK OFFICE

CERTIFICATE OF CORRECTION

PATENT NO. : 4 527 455

DATED : July 9, 1985

INVENTOR(S) : Francois Morax

It is certified that error appears in the above-identified patent and that said Letters Patent is hereby corrected as shown below:

Column 4, line 41; after "disposed in" insert ---said slot and having its ends respectively disposed against---.

Signed and Sealed this

*Seventh* Day of *January 1986*

[SEAL]

*Attest:*

*Attesting Officer*

DONALD J. QUIGG

*Commissioner of Patents and Trademarks*